US005248914A

United States Patent [19]

Capek et al.

[11] Patent Number: 5,248,914

[45] Date of Patent: Sep. 28, 1993

[54] IN PROCESS TENSION MASK CRT PANEL WITH PERIPHERAL BODIES

[75] Inventors: Raymond G. Capek, Elmhurst; James R. Fendley, Arlington Heights; Mark T. Fondrk, Chicago, all of Ill.

[73] Assignee: Zenith Electronics Corporation, Glenview, Ill.

[21] Appl. No.: 851,433

[22] Filed: Apr. 24, 1992

Related U.S. Application Data

[60] Division of Ser. No. 685,352, Apr. 15, 1991, Pat. No. 5,127,865, which is a continuation-in-part of Ser. No. 634,270, Dec. 26, 1990, Pat. No. 5,146,132.

[51] Int. Cl.[5] ..... H01J 29/82

[52] U.S. Cl. ..... 313/402; 313/406; 313/407; 313/408; 313/477 R; 220/2.1 A

[58] Field of Search ..... 313/402, 406, 407, 408, 313/477 R, 456; 220/2.1 R, 2.3 A

[56] References Cited

U.S. PATENT DOCUMENTS

| | | | |
|---|---|---|---|
| 2,799,422 | 7/1957 | Hagenberg | 220/2.3 A X |
| 4,004,092 | 1/1977 | Rogers | 220/2.1 A X |
| 4,016,364 | 4/1977 | Rogers | 220/2.1 A X |
| 4,268,712 | 5/1981 | Overall | 174/50.63 |
| 4,593,224 | 6/1986 | Palac | 313/402 |
| 4,593,225 | 6/1986 | Dietch et al. | 313/407 |
| 4,595,857 | 6/1986 | Rowe et al. | 313/407 |
| 4,686,415 | 8/1987 | Strauss | 313/402 |
| 4,704,094 | 11/1987 | Stempfle | 445/30 |
| 4,712,041 | 12/1987 | Greiner et al. | 313/407 |
| 4,737,681 | 4/1988 | Dietch et al. | 313/402 |
| 4,745,330 | 5/1988 | Capek et al. | 313/407 |
| 4,826,463 | 5/1989 | Strauss | 445/45 |
| 4,884,006 | 11/1989 | Prazak | 313/477 R X |
| 4,891,546 | 1/1990 | Dougherty et al. | 313/402 X |
| 4,900,977 | 2/1990 | Lopata et al. | 313/407 |
| 4,925,421 | 5/1990 | Brook | 313/308 X |
| 4,930,015 | 5/1990 | Dougherty et al. | 313/477 R X |
| 4,994,712 | 2/1991 | Strauss | 313/407 X |
| 5,047,684 | 9/1991 | Capek et al. | 313/407 |
| 5,049,778 | 9/1991 | Capek et al. | 313/407 |
| 5,086,251 | 2/1992 | Capek et al. | 313/407 |

FOREIGN PATENT DOCUMENTS 1477706 3/1967 France .

*Primary Examiner*—Donald J. Yusko
*Assistant Examiner*—Ashok Patel
*Attorney, Agent, or Firm*—Roland Norris

[57] ABSTRACT

An annulus attached adjacent the edge planes of a CRT front panel provides screen area savings, and in the preferred embodiment, panel protection, strengthening, and anti-implosion properties. The annulus is preferably composed of a plurality of sections and incorporates a shadow mask support. The annulus is attached to the front panel before receiving the shadow mask becomes a part of the CRT envelope. In a preferred embodiment, the annulus is composed of ceramic and is x-ray shielded by an application of lead-based frit.

4 Claims, 5 Drawing Sheets

IN PROCESS TENSION MASK CRT PANEL WITH PERIPHERAL BODIES

REFERENCE TO RELATED APPLICATION

This application is a divisional application U.S. patent application Ser. No. 07/685,352 filed Apr. 15, 1991, now U.S. Pat. No. 5,127,865, which application is a continuation-in-part of Ser. No. 07/634,270, filed Dec. 26, 1990, now U.S. Pat. No. 5,146,132, commonly owned herewith.

This application is also related to, but not dependent upon, pending application 07/634,644 filed Dec. 27, 1990, now U.S. Pat. No. 5,049,778, also commonly owned herewith.

SU BACKGROUND OF THE INVENTION

1. Field of the Invention

The present invention relates generally to cathode ray tube (CRT) manufacture. More specifically the present invention relates to tensioned-mask color CRT manufacture.

2. Background of the Invention

It is known in the art of CRT manufacture to provide the color CRT with a tensioned shadow mask to direct electron beams to the proper image-producing phosphors on the screen. The tensioned shadow mask offers advantages in CRT power handling capability, conservation of materials, and ruggedization over the familiar free-standing, framed shadow mask.

A current method of phosphor screen deposition is photolithography through a production shadow mask which is then mated to that particular screened panel for incorporation into the working CRT. This led to several tensioned mask CRT designs which seek to secure the tensed mask to a self-supporting mask frame. The tensed mask and frame are used for screen deposition and later incorporated into the operating CRT. Examples include U.S. Pat. No. 4,704,094 to Stempfle; and U.S. Pat. No. 4,595,857 to Rowe et al., owned by the assignee hereof. The U.S. Patents cited incorporate the mask and self-supporting frame into the CRT envelope. However, if the self-supporting frame is not sufficiently heavy and rigid it will distort under the forces applied to it by the affixed tensed mask. The mask aperture pattern of the tensed mask will likewise be distorted. This distortion is "transferred" to the screen during photodeposition when utilizing the tensed mask and frame structure as the "photo-template". But, when incorporating the mask and frame structure into the finished tube at elevated temperatures the strain of the tensed mask is relieved, allowing the frame to resume an undistorted shape. The frame is then "frozen" in this undistorted shape upon incorporation into the tube envelope, resulting in an undistorted shadow mask aperture pattern, upon cooling of the tube. Thus, misregistration between the applied screen and the operational tube shadow mask aperture pattern will result. The reader is referred to U.S. Pat. No. 4,686,415, commonly owned herewith, for a further exposition of this phenomenon.

Such "self-supporting" frame designs also negate the possible material saving advantages of tensioned mask design by still requiring a mask frame heavy enough to prevent distortion of the attached mask during screen deposition photolithography.

In order to overcome the problems attendant with incorporating the mask and self-supporting frame into the CRT, the assignee hereof, as generally disclosed in U.S. Pat. No. 4,737,681; tenses the mask on a separate assembly or frame and uses a shadow mask support affixed directly to the interior surface of the front panel. In this manner the tensed mask support may derive mask-holding strength from the front panel, thereby realizing material and weight savings. Further, this arrangement allows for direct measurement of, and compensation for, the critical mask-to-screen distance, or "Q"-height, while allowing easy access to the mask support surface during manufacture of the CRT.

However, this particular panel-mounted mask support design requires increased usage of the front panel glass area which might otherwise be used for the application of image-forming screen phosphors. This results in an undesirable loss of screen area per unit area of panel glass and overall enlargement of, for example, a television set for a given screen size. Panel glass is also known to be heavy and, in its current individually stamped panel form, expensive.

Relatedly, and as disclosed in U.S. Pat. No. 4,816,053 to Palac, commonly owned herewith; flat tensioned mask CRTs may utilize less expensive float glass for the front panel. However, to date it has been found that float glass is difficult to work with in CRT applications owing to its edge finishing requirements necessitated by its sharp edges upon scoring and breaking, or rough edges upon abrasive cutting. Rough float glass panel edges are believed to contribute to an increased sensitivity to panel breakage during CRT manufacture. Sharp edges are, of course, a safety hazard. Edge finishing requires additional expense.

Thus, in order to obtain the inherent advantages of tensioned mask CRTs there is needed a mask support system which utilizes the strength of other CRT envelope components and provides for maximum screen area per unit area of panel glass. Further, cost advantages of tensed mask CRTs may be realized with a reliable way of using float glass for the front panel.

Other references of possible interest may include U.S. Pat. Nos. 4,593,224; 4,593,225; 4,826,463 and 4,595,857, commonly owned herewith; as well as U.S. Patent Nos. 4,900,977 and 4,925,421.

OBJECTS OF THE INVENTION

Some objects of the present invention include:

1. achieving a tensioned mask CRT with maximum screen area per unit area of panel glass,
2. achieving a practical utilization of float glass for CRT front panels,
3. achieving a CRT envelope that is inherently implosion resistant, and
4. achieving material and manufacture savings in a color CRT.

Other attendant advantages will be more readily appreciated as the invention becomes better understood by reference to the following detailed description and compared in connection with the accompanying drawings, in which like reference numerals designate like parts throughout the figures. It will be appreciated that the drawings may be exaggerated for explanatory purposes.

| Brief Index of Reference Numerals |
|---|
| 11. CRT |
| 12 Frame |
| 13. Panel |

-continued

| Brief Index of Reference Numerals |
|---|
| 14. Mitred Joint |
| 15. Funnel |
| 16. Electron Beams |
| 17. Mask Support Structure |
| 18. Circumferential Ceramic Body Section |
| 19. Gun |
| 21. Neck |
| 23. Tensioned Shadow Mask |
| 24. Welds |
| 25. Panel Interior Surface |
| 27. Panel Exterior Surface |
| 28. Screen |
| 29. Phosphor Elements |
| 31. Edges |
| 33. Edge Plane Surfaces |
| 35. Ceramic Body |
| 37. Recess |
| 39. Metallic Strip |
| 40. Low Viscosity Cementious Mat'l. |
| 41. Frit |
| 43. 1st Surface |
| 44. Laser Head |
| 45. Mask Attachment Surface |
| 46. Angle |
| 47. Second Surface |
| 48. Laser Beam |
| 49. 1st Leg |
| 50. Peripheral Section |
| 51. Interior Panel Land Surface |
| 52. Mask Periphery |
| 53. Dashed Line (CTE Boundary) |
| 55. Glass Tension Region |
| 57. Second Leg |
| 59. Exterior Panel Land Surface |
| 61. Setback Distance |
| 63. Mask Support Surface Bearing Section |

DESCRIPTION OF THE PREFERRED EMBODIMENTS

Figure 1:
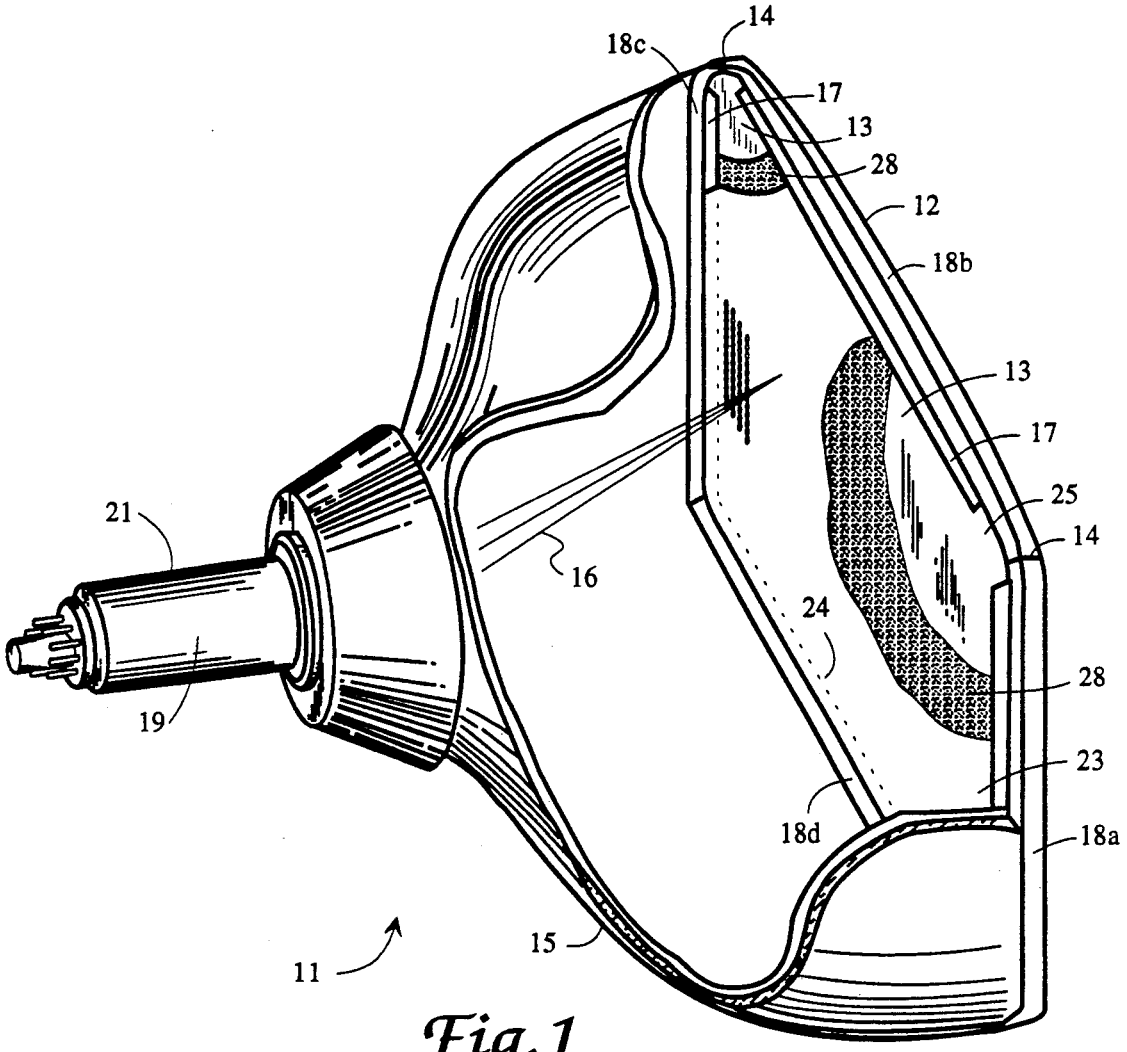
FIG. 1 is a perspective view, partially cut away, of a CRT envelope embodying the present invention.
Figure 2:
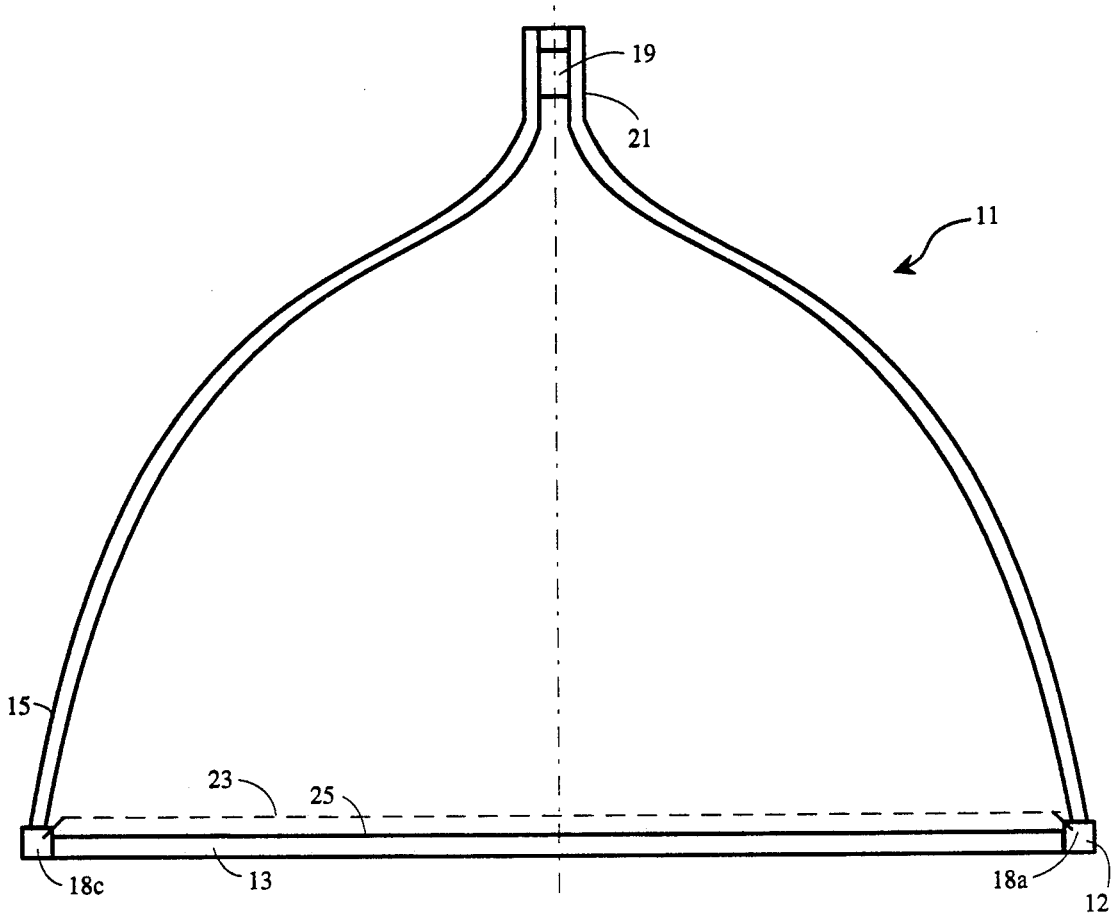
FIG. 2 is a cross section of a CRT envelope incorporating one embodiment of the present invention.

As seen in FIGS. 1 and 2, a cathode ray tube (CRT) 11 comprises a hermetically sealed envelope having a front panel 13, a funnel 15, a mask support structure 17, and an electron gun 19 sealed within a neck 21. Within the CRT envelope is suspended a taut, or tensioned, shadow mask 23 parallel to the screen 28 on the interior surface 25 of the panel 13.

According to a preferred embodiment of the invention, a frame 12, or annulus, surrounds the front panel 13 of a cathode ray tube 11. The panel 13 is glass and carries thereon an image-forming cathodoluminescent screen 28 comprised of phosphors exitable by electron beams 16 emitted from the gun 19. The frame 12 comprises a plurality of coplanar ceramic bodies, 18*a*, 18*b*, 18*c*, and 18*d*, interconnected to form an annulus. Thus, each body 18*a*–18*d* may be fabricated as a straight piece thereby reducing fabrication costs. The ceramic bodies 18*a*, 18*b*, 18*c*, and 18*d* are joined by a devitrifyable solder glass at mitred joints 14 located on corners of the panel 13. The ceramic bodies 18*a*, 18*b*, 18*c* and 18*d* incorporate the mask support structure 17 thereon. The mask 23 is affixed to the mask support structure 17 by welds 24. The frame 12 is incorporated into the sealed envelope of the CRT 11 through its attachment to the panel 13 and the funnel 15.

As more fully explained below, the disclosed embodiments of structures, or bodies, affixed to the periphery of CRT flat panel glass offer several advantages over the heretofore contemplated CRT front panel assembly schemes. Bodies abutting the edge planes of the CRT panel afford protection to the panel edges where cracking of the panel glass is most likely to start. Also, standoffs may be incorporated into the bodies to prevent marring of the panel inner and outer surfaces. Further, these bodies can exert compressive forces on the panel through proper material composition selection which afford anti-implosion properties to the panel.

Bodies 18*a*–*d* affixed on the panel periphery may further incorporate a tensed shadow mask support structure 17 which derives from the panel 13 strength to hold the tensed mask 23 without deformation. Material and weight savings are thus realized. Concurrently, this peripherally mounted mask support structure 17 will consume little of the panel inner surface area which must be used to form the imaging screen of the CRT. Thus, a given panel area may exhibit a larger screen size than previously possible leading to material savings throughout the manufacture of, for example, a television set.

Figure 3A:
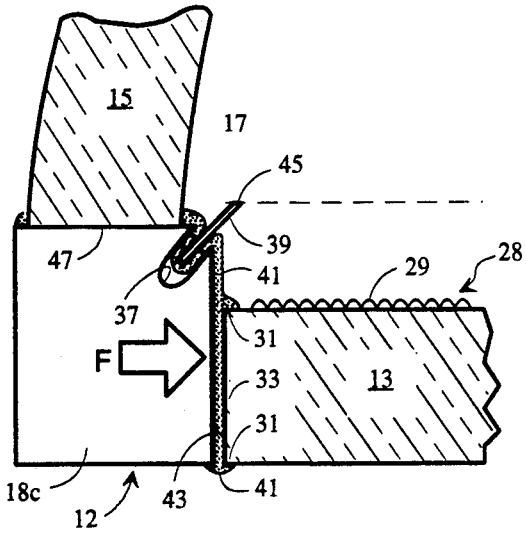
FIG. 3A is a detailed view of the embodiment of FIG. 2.

As seen in more detail in FIGS. 3A and B, the front panel 13 is a transparent flat plate preferably composed of float glass which is more economical than the individually pressed or stamped glass front panels commonly used today. The front panel 13 has an exterior surface 27 opposite the interior surface 25. The interior surface 25 will have deposited thereon a screen 28 comprising an array of phosphor elements 29. The panel also has edges 31 and edge plane surfaces 33 extending between the edges 31 and typically orthogonal to the interior and exterior surfaces 25, 27 respectively.

Adjacent to the edge plane surfaces 33 is located the frame 12 preferably composed of ceramic and incorporating a mask support structure 17. The mask support structure 17 comprises a recess 37, shown for clarity as half-filled but understood to be completely filled, in which is affixed a metallic strip 39 by means of a television grade solder glass commonly called devitrifying frit 41, or the like, such as a high temperature, low viscosity cementitious material, e.g. porcelain enamel compounds, or glass of a suitable CTE. Ceramic is chosen for the body material because it is an inexpensive, high-strength, glass-compatible structural material. It will be appreciated that other body compositions, including metal alloys may have the requisite structural properties. The frame 12 has a first surface 43 abutting the panel edge plane 33 and affixed thereto by means of devitrifying frit 41. It will be noted that, in this embodiment, the frit 41 covers the abutting surfaces of the frame 12 and panel 13 so as to overlap and protect the panel edge 31 and the panel edge plane surfaces 33. This panel edge protection is particularly important in the case of float glass panels which are more susceptible to edge anomaly or contact induced cracking than are pressed glass panels. It will be noted that the frit 41 continues up the first surface 43 of the frame 12 parallel to tube axis to provide x-ray shielding due to its lead-based composition. Alternatively, the ceramic composition of the frame 12 may include x-ray shielding materials. Other x-ray shielding suitable to the tube environment, such as lead foil, might also be overlaid in this area.

Through proper selection and shaping of its materials the frame 12 will impart to the panel and envelope both additional strength and anti-implosion properties.

Figure 3B:
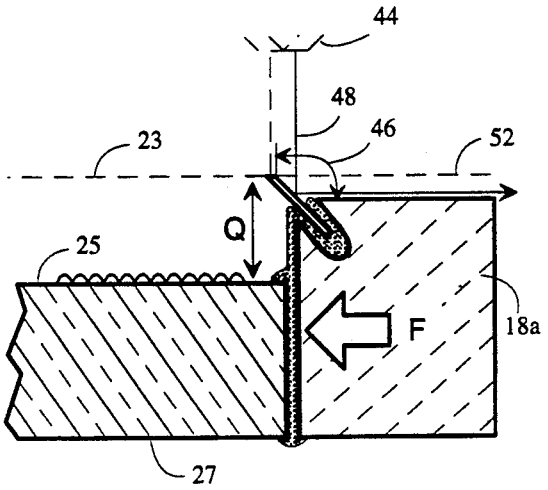
FIG. 3B illustrates the process of welding and trimming the foil shadow mask mounted according to the present invention and using a laser.
Figure 4A:
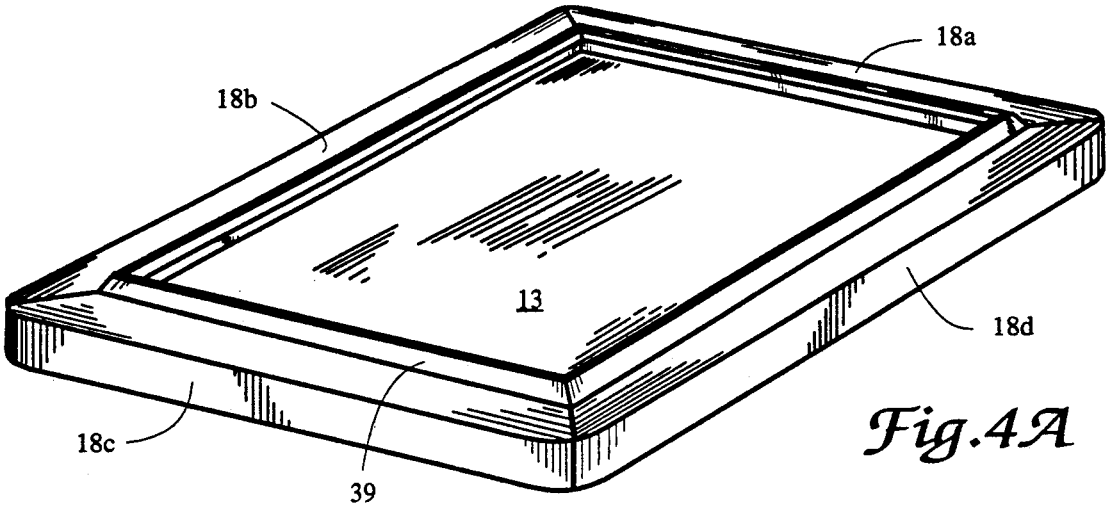
FIG. 4A is a perspective view of a four piece panel and mask support annulus embodying the present invention.

As seen in FIG. 4A, the frame 12 may be comprised of a plurality of circumferential sections 18*a*, 18*b*, 18*c*, 18*d*, interconnected by frit or the like, to form the frame 12 around the panel 13. By choosing a ceramic composition with a higher coefficient of thermal contraction, also called coefficient of thermal expansion (CTE) than the panel 13, the frame 12 will impart a compressive force F (FIGS. 3A, 3B) on the panel glass. Because glass is strong under compression, the strength imparted to the panel 13 by this arrangement of elements will result in a panel less susceptible to thermal shock during CRT manufacture.

Figure 4B:
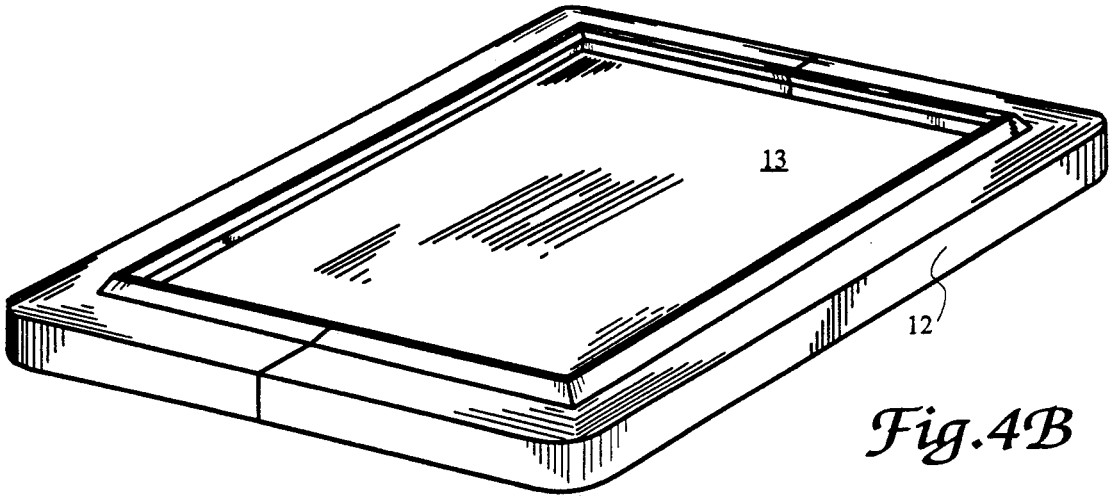
FIG. 4B is a view of an alternative two-piece arrangement of the mask support annulus of FIG. 4A.

With sufficient compression the frame 12, such as shown in FIG. 4B may further serve to compress the panel corners and/or edges and act as an anti-implosion device having "tension band" properties which replace the currently used post-processing metal tension bands surrounding the panel as shown e.g., in U.S. Pat. No. 4,930,015 commonly owned herewith. Implosion protection of the "rim-bond" type is also realized because the frame 12 binds the edges 31 of the panel 13 during shattering long enough to slow the inrush of pressure into the evacuated tube 11. The reader is referred to the related discussion in U.S. Pat. Nos. 4,004,092 and 4,016,364. Further, due to increased glass strength a thinner panel 13 may be used resulting in process time and weight savings, thinner funnel seal lands, and better quality panel glass.

Also, because the compressive force F is exerted equally around the panel 13 no distortion of the panel Will occur during attachment of the mask support structure 17 to disturb the planar topography of the interior surface 25 onto which the screen 28 is, or will later be, deposited.

Returning to FIG. 3A, the metallic strip 39, of the mask support structure 17 presents a mask attachment surface 45 to the interior of the CRT 11. The mask attachment surface 45 faces away from the panel interior surface 25 for ease of "Q"-height adjustment and subsequent mask attachment preferably by welding, although cementation, mechanical devices, or the like, may be suitably used.

As seen in FIG. 3B, typically, the mask 23 is a metal foil which is spot welded by laser head 44 in its tensed state to the mask attachment surface 45, after the metallic strip 39 has been ground to provide a clean and planar welding surface at a predetermined distance "Q" from the panel interior surface 25. The laser head 44 is then moved distally from the screen 28 and a continuous laser beam 48 is used to trim away the excess mask periphery 52. The metallic strip 39 is set in the mask support structure 17 at an angle 46 to this laser beam 48, so as to deflect the laser beam 48 away from the frame 12, thus preventing the burning thereof. Other mask support surface designs may be suitably integrated into the ceramic body as desired, as for example, the simple straight metal strip 39 of FIG. 10, attached to the ceramic body and extending in the axial direction of the tube. Preferred attachment materials include high temperature low viscosity cementitious materials 40 which will fill the voids between the strip 39 and frame 12 through capillary action. It will be noted that the metallic strip 39 embodiment of FIG. 10 does not supply laser shielding for the ceramic body 35. Laser cutting must then be performed outside the ceramic body area or mechanical cutting of the mask must be performed. The reader is also referred to copending application Ser. No. 07/634,644, Filed Dec. 27, 1990; and the related discussion therein, for further metallic strip placement examples.

It will be appreciated that because the mask support structure 17 is located on the periphery of the panel 13, more space than in prior approaches is available on the panel interior surface 25 to be occupied by the image-producing screen 28. Due to this peripheral placement of the frame 12 and the incorporated mask support structure 17, the CRT funnel 15 is affixed to a second surface 47 of the frame 12 thereby incorporating the frame 12 into the CRT envelope.

Figure 4C:
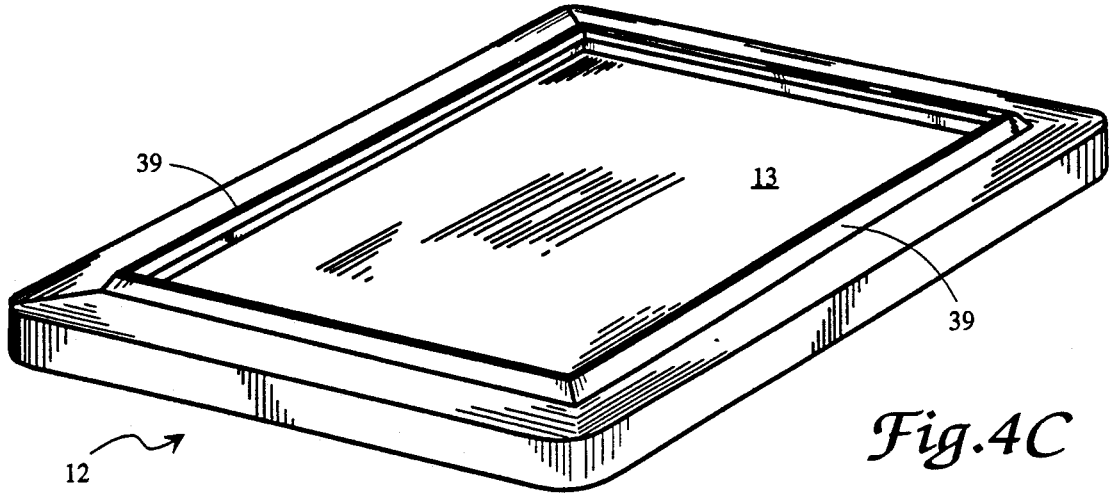
FIG. 4C is a view of an alternative two-piece arrangement of the mask support annulus of FIG. 4B.

Although illustrated throughout as being flat, the panel 13 may also be cylindrical as through use of pressed glass or a float glass with a predetermined curvature of finite radius ground therein. Further, while FIG. 1 illustrates the bodies 18*a*–18*d* as having four corner joints at forty-five degree angles, other joint arrangements may be suitably used in accordance with the present invention, such as, e.g. shown in FIGS. 4B and 4C.

Figure 5:
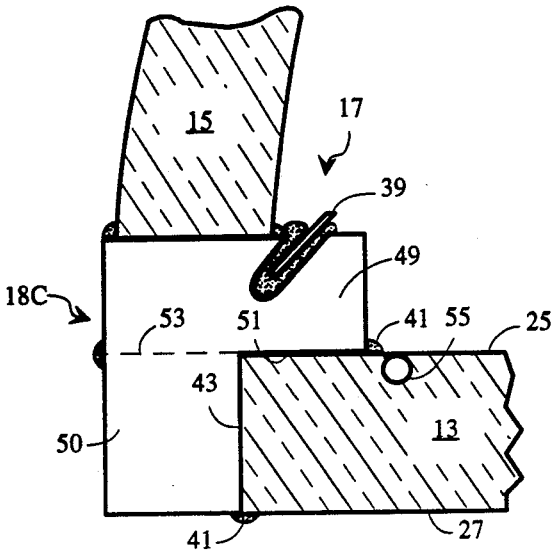
FIG. 5 is a cross-sectional view of an "L"-shaped peripheral body according to the present invention.

As seen in FIG. 5, a first leg 49 has been added to a peripheral section 50 as a part of the body 18C which incorporates the mask support structure 17. The first leg 49 has an interior panel land surface 51 attached to the interior surface 25 of the panel 13.

The CTE of the first leg 49 is preferably made substantially equal to the CTE of the panel glass to avoid inducing undesirable strain, especially at the ceramic-to-glass interface 55, on the panel interior surface 25 during thermal cycling. Alternatively, the first leg CTE, can be lower than that of the glass to induce compression into the panel glass at interface 55. The first leg 49 ma be fabricated as a separate structure, as indicated by dashed line 53, and attached to the peripheral section 50 with frit 41 or formed integral to the body 18c during forming thereof by multiple extrusion or the like. The reader is referred to U.S. Pat. No. 4,745,330 for a more detailed discussion of differential CTE mask support structures.

Figure 6:
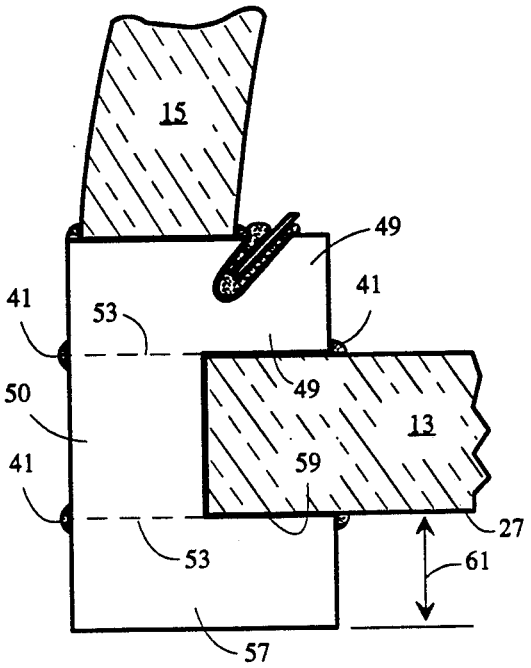
FIG. 6 is a cross-sectional view of a "U"-shaped peripheral body according to the present invention.

As seen in FIG. 6, in order to counteract any bending of the panel 13 caused by affixation of the first leg 49 to the interior surface 25, a counter-effect second leg 57 having a exterior panel land surface 59 contacting the panel exterior surface 27 is also added to the peripheral section 50. A related discussion of a "U"-shaped cross-section panel frame is found in the parent U.S. patent application Ser. No. 07/634 270; Filing Date: Dec. 12, 1990, now U.S. Pat. No. 5,146,132. As noted above, the CTE of the first and second legs 49, 57, respectively, may be a different CTE than that of the peripheral section 50 as indicated again by the dashed line 53.

Figure 7:
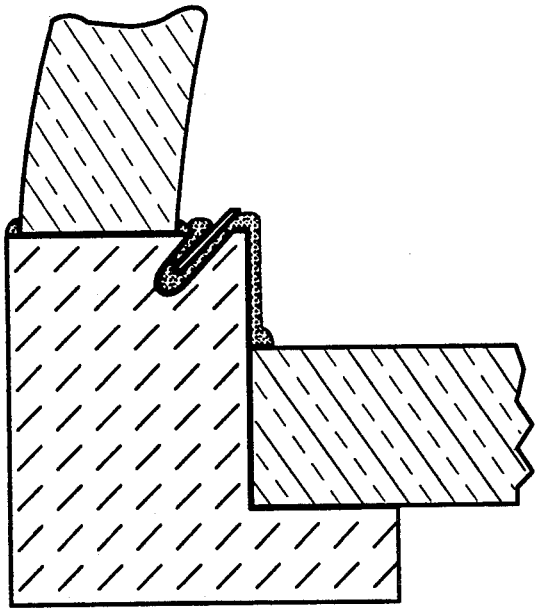
FIG. 7 is a cross-sectional view of an "L"-shaped peripheral body, the leg of the "L" being located on the exterior surface of the front panel.

Referring to FIGS. 5 and 6, it will be appreciated that a certain amount of screen area is sacrificed on the panel 13 in order to provide added support mass for metallic strip 39 when incorporating the mask support 17 into the frame 12 and additional contact area for affixation of the frame 12 to the panel 13. The embodiment of FIG. 6 will be seen to provide the maximum edge protection for the panel 13 as well as a set back distance 61 protecting the panel exterior surface 27 from damaging contact with the environment during handling, thereby reducing rejects or the need for subsequent corrective measures such as buffing the scratches from the exterior surface 27. The embodiment of FIG. 7 provides many of these advantages, and by eliminating the interior panel land surface 51, allows for one-piece construction of the frame if desired.

Figure 8:
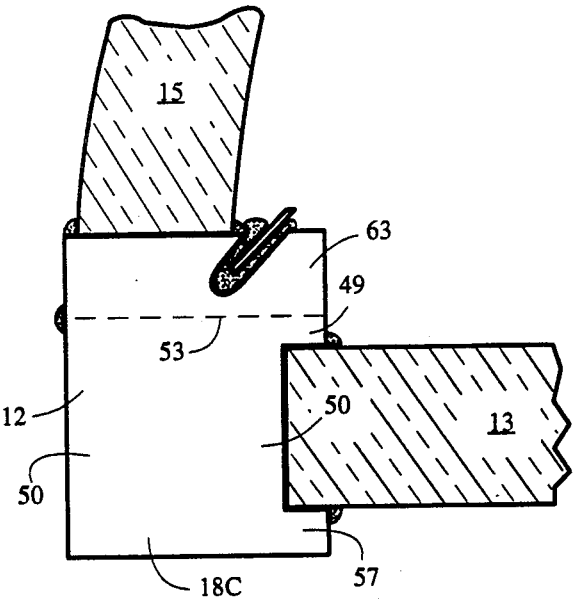
FIG. 8 is a cross-sectional view of alternative embodiment according to the present invention, wherein a mask support structure is added to a separate edge protecting body.
Figure 9:
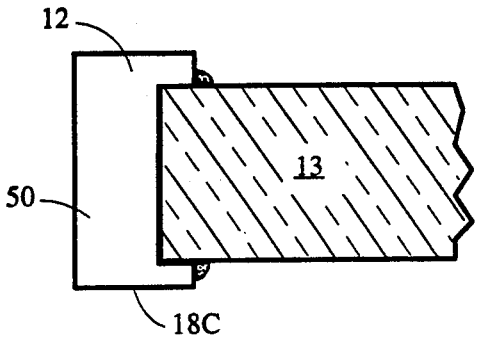
FIG. 9 is a panel edge protective body according to the present invention.

As seen in FIGS.8 & 9, the legs 49 and 57 may be down-sized in order to retain panel protective properties while maximizing useful screen area on the panel 13. Further, the peripheral section 50 of the body 18C may be suitably used as a panel edge protector without concurrent addition of the mask support surface bearing section 63, as seen in FIG. 8.

Figure 10:
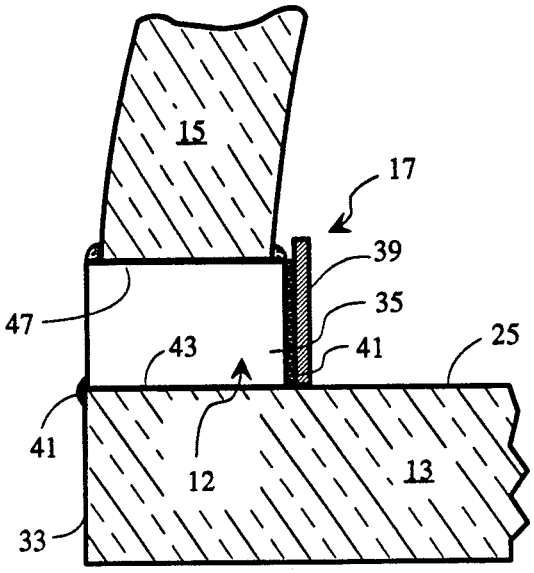
FIG. 10 is a cross-sectional view of a peripheral body affixed adjacent the panel edge plane according to the present invention.

As seen in FIG.10 an alternative embodiment of the invention may be utilized where panel compression and edge protection from the body 35 are not deemed necessary. The metallic strip 39 is affixed to the frame 12 to incorporate the mask support 17 therein. The frame first surface 43 is affixed by frit 41 adjacent the panel edge plane 33 on the panel interior surface 25. The body second surface 47 is affixed to the funnel 15. This embodiment represents a minimum material usage for the frame 12 while conserving available screen area and hiding the frame 12 from frontal viewing, as may be cosmetically desirable. Further, this embodiment provides the option of one piece fabrication of the frame 12 where desired.

Figure 11:
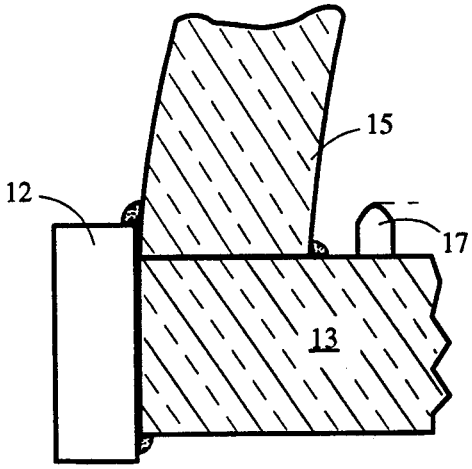
FIG. 11 illustrates a panel edge protective body not incorporating a mask support structure.

FIG. 11 illustrates an embodiment of the present invention wherein the frame 12 is not incorporated into the CRT envelope, but merely used for its panel and implosion protecting properties.

While the present invention has been illustrated and described in connection with the preferred embodiments, it is not to be limited to the particular structure shown, because many variations thereof will be evident to one skilled in the art and are intended to be encompassed in the present invention as set forth in the following claims:

Having thus described the invention, what is claimed is:

1. An in-process CRT front panel assembly comprising:

a) a substantially flat glass panel; and b) a body of polygonal cross-section and of suitable composition for being incorporated into a CRT envelope, the body having:

1) a first surface affixed to and abutting an edge plane surface of the glass panel, and, 2) a second surface for affixation to a CRT funnel; and, c) a weldable element located on the body constructed and arranged for retaining a shadow mask thereon.

2. The assembly of claim 1 wherein the body has a cross section which is substantially "U"-shaped, the bight of said "U"-shape being the first surface.

3. The assembly of claim 1 wherein the body has a cross section which is substantially "L"-shaped with one leg of said "L"-shape abutting the edge plane surface of the panel.

4. The assembly of claim 1 wherein the body is composed of a plurality of co-planar circumferential sections interconnected to form a frame.

* * * * *

UNITED STATES PATENT AND TRADEMARK OFFICE

CERTIFICATE OF CORRECTION

PATENT NO. : 5,248,914
DATED : September 28, 1993
INVENTOR(S) : Raymond G. Capek, et. al.

It is certified that error appears in the above-indentified patent and that said Letters Patent is hereby corrected as shown below:

On the Title page, item [75], inventor: delete James R. Fendley--.

Signed and Sealed this

Twenty-fifth Day of October, 1994

*Attest:*

Bruce Lehman

BRUCE LEHMAN

*Attesting Officer*

*Commissioner of Patents and Trademarks*